United States Patent [19]

Kirschen

[11] 4,320,603

[45] Mar. 23, 1982

[54] ROOF CONSTRUCTION

[76] Inventor: Solomon Kirschen, 1727 Danforth St., Philadelphia, Pa. 19152

[21] Appl. No.: 221,526

[22] Filed: Dec. 31, 1980

Related U.S. Application Data

[63] Continuation of Ser. No. 159,935, Jun. 16, 1980, abandoned.

[51] Int. Cl.[3] ..... E04B 7/12

[52] U.S. Cl. ..... 52/18; 52/80; 52/83

[58] Field of Search ..... 52/80, 81, 82, 83, 18, 52/223, 227, 228, 229

[56] References Cited

U.S. PATENT DOCUMENTS

| | | | |
|---|---|---|---|
| 1,347,669 | 7/1920 | Ballinger | 52/18 |
| 3,014,558 | 12/1961 | Noyes | 52/223 R |
| 3,090,162 | 5/1963 | Baroni | 52/80 |
| 3,092,932 | 6/1963 | Wilson | 52/80 |
| 3,206,895 | 9/1965 | Ridder | 52/80 |
| 3,591,991 | 7/1971 | Zetlin | 52/18 |
| 3,653,166 | 4/1972 | Kirschen | 52/80 |
| 3,788,014 | 1/1974 | Semisch | 52/18 |

FOREIGN PATENT DOCUMENTS

| | | | |
|---|---|---|---|
| 660541 | 5/1938 | Fed. Rep. of Germany | 52/81 |
| 751 | of 1862 | United Kingdom | 52/83 |

*Primary Examiner*—Price C. Faw, Jr.
*Assistant Examiner*—Henry E. Raduazo
*Attorney, Agent, or Firm*—Weiser, Stapler & Spivak

[57] ABSTRACT

A roof construction includes multiple hyperbolic paraboloid units joined together at adjacent peripheral edges to form a multi-unit roof span. These units include both horizontally extending edges and sloping edges, and vertical members to support the roof at the ends of only some of the sloping edges. Horizontally disposed and tensioned or compressed members connect ends of sloping edges that are unsupported by vertical members with ends of sloping edges that are supported by vertical members to transmit horizontal forces between the connected ends. This construction can be employed to form a large roof span without using interior vertical support members.

6 Claims, 5 Drawing Figures

ROOF CONSTRUCTION

This is a continuation, of application Ser. No. 159,935, filed June 16, 1980 and now abandoned.

BACKGROUND OF THE INVENTION

This invention relates to a roof construction formed from multiple hyperbolic paraboloid units, and more particularly to a roof construction in which the multiple units are joined together at contiguous surfaces and are supported by both vertical members and horizontally disposed and tensioned or compressed members.

Roof constructions employing hyperbolic paraboloid units are known in the prior art. In fact, applicant is the inventor of a laminated hyperbolic paraboloid unit that is described and claimed in U.S. Pat. o. 3,653,166. The disclosure of the '166 patent is incorporated herein by reference and describes the unit that is preferred for use in this invention.

A hyperbolic paraboloid unit makes efficient use of materials by relying on form or shape for strength, rather than on mass or depth of bending members. Specifically, a hyperbolic paraboloid unit contains two sets of parabolic curves, which, in plan view, extend in the diagonal directions of the unit. One set of parabolas is concave downwardly and the other set in concave upwardly, and a uniform load on the unit is carried in the two diagonal directions by the series of parabolas. The set of parabolas that is concave downwardly carries its load in axial compression, as in an arch, while the set of parabolas that is concave upwardly carries its load in tension, as in a cable.

A hyperbolic paraboloid unit, or shell, can be divided into four quadrants; each quadrant having a shell field that includes the two sets of parabolas in the diagonal directions. Most preferably, the edges of each quadrant are provided with stiffening members, and the quadrants are connected together through the stiffening members to form the complete hyperbolic paraboloid unit.

For many small building constructions it may be practical to employ a single hyperbolic paraboloid unit for the entire roof span. This is the case when it is easy to ship the unit with at least the quadrants fully assembled. If the quadrants are complete it is a fairly easy matter to assemble the unit on site by merely connecting the quadrants together. However, it is not desirable to employ a single unit to form an entire roof span when the span is so large that it is impractical to ship the unit with at least the quadrants in a fully assembled state. On site completion of the quadrants is a difficult and time consuming task. In the latter discussed situation, it is preferred to form the span from multiple units that are of a size permitting easy shipment of fully assembled quadrants. It is also desirable to form a roof construction without using interior vertical supports. Obviously, by omitting such supports the area under the roof span will be unobstructed and can be most effectively utilized. Roof constructions that are free of interior vertical columns are referred to as "free span" roof constructions.

A free span roof construction formed of multiple hyperbolic paraboloid units is employed in the athletic facility at the Pratt Institute in Brooklyn, New York. This roof construction is primarily a three-hinged arch that depends upon long sloping compression struts to transmit the load from the interior area of the roof to peripheral vertical buttresses. Although the sloping strut arrangement creates a high vaulted interior, which may be desirable for some installations, it does so by transmitting a large horizontal component of load to the vertical buttresses. The heavy buttresses and strong foundation necessary to support these large loads are expensive to construct. Furthermore, the sloping struts are formed from heavy members because they are required to carry large loads, and these heavy struts are also quite expensive to use in roof construction. The roof construction of the present invention does not require the use of heavy sloping struts, and can employ lighter and less expensive vertical supports than those employed in the above described three-hinged arch arrangement.

SUMMARY OF THE INVENTION

The roof construction of this invention includes multiple hyperbolic paraboloid units that are joined together at contiguous surfaces thereof to provide the desired roof span. The multiple unit roof span includes both horizontally extending edges and sloping edges, and vertical members to support the roof at the ends of only some of the sloping edges. Preferably the vertically supported ends of the sloping members are all adjacent the periphery of the roof span to provide a free span construction. Horizontally disposed and tensioned or compressed members connect ends of sloping edges that are unsupported by vertical members with ends of sloping edges that are supported by vertical members to transmit horizontal forces between the connected ends. Most preferably, an end of each sloping edge is in force transmitting communication with a horizontally disposed and tensioned or compressed member.

The hyperbolic paraboloid units cooperate with the horizontally tensioned or compressed members to provide a statically determinate truss. This permits large roof spans to be supported without the use of heavy and expensive buttresses, foundations and sloping struts of the type which must be employed in the high vaulted, three-hinged arch construction discussed earlier.

A hyperbolic paraboloid unit, as defined in this application, includes four quadrants and each quadrant has a shell field of hyperbolic paraboloid configuration. In other words, each quadrant has a double curvature which permits loads to be transferred to supports entirely by direct forces so that all of the material in the cross-section of each quadrant of the unit is uniformly stressed. Most preferably, each of the quadrants consists of the hyperbolic paraboloid shell field and stiffening members, such as edge beams, connected to all four edges. Each hyperbolic paraboloid unit (i.e., a set of four quadrants) is assembled by connecting the quadrants together through the stiffened edges. The orientation of the quadrants within the units can be varied to provide different shapes and configurations as desired. Most preferably, the hyperbolic paraboloid units employed in this invention are the laminated wood constructions disclosed in my issued U.S. Pat. No. 3,653,166. That patent has already been incorporated herein by reference.

Most preferably the horizontally extending edges in the multiple unit roof span are formed by stiffening members, such as edge beams, and these edges lie in a common horizontal plane. The horizontally disposed and tensioned or compressed members are in a different plane than the stiffened horizontal edges and these tensioned or compressed members cooperate with the stiffened edges and the shell fields to provide the statically determinate truss. In other words, the stiffened horizontal edges of the roof span provide one chord of the truss, the horizontally tensioned or compressed members connected with the ends of sloping edges provide a second chord of the truss and the sloping edges and the shell fields provide connecting webs between the two chords to complete the truss arrangement.

In accordance with this invention, the hyperbolic paraboloid units can be connected together in two horizontal directions to form large roof spans that do not require internal vertical supports. Although high vaulted, three-hinged arch constructions are not formed in accordance with this invention, different constructions can be formed, such as cantilever and continuous truss constructions.

Other objects and advantages, as well as a fuller understanding of the invention will be had by referring to the following description and claims of a preferred embodiment thereof taken in conjunction with the accompanying drawings.

DESCRIPTION OF THE PREFERRED EMBODIMENT OF THE INVENTION

Figure 1:
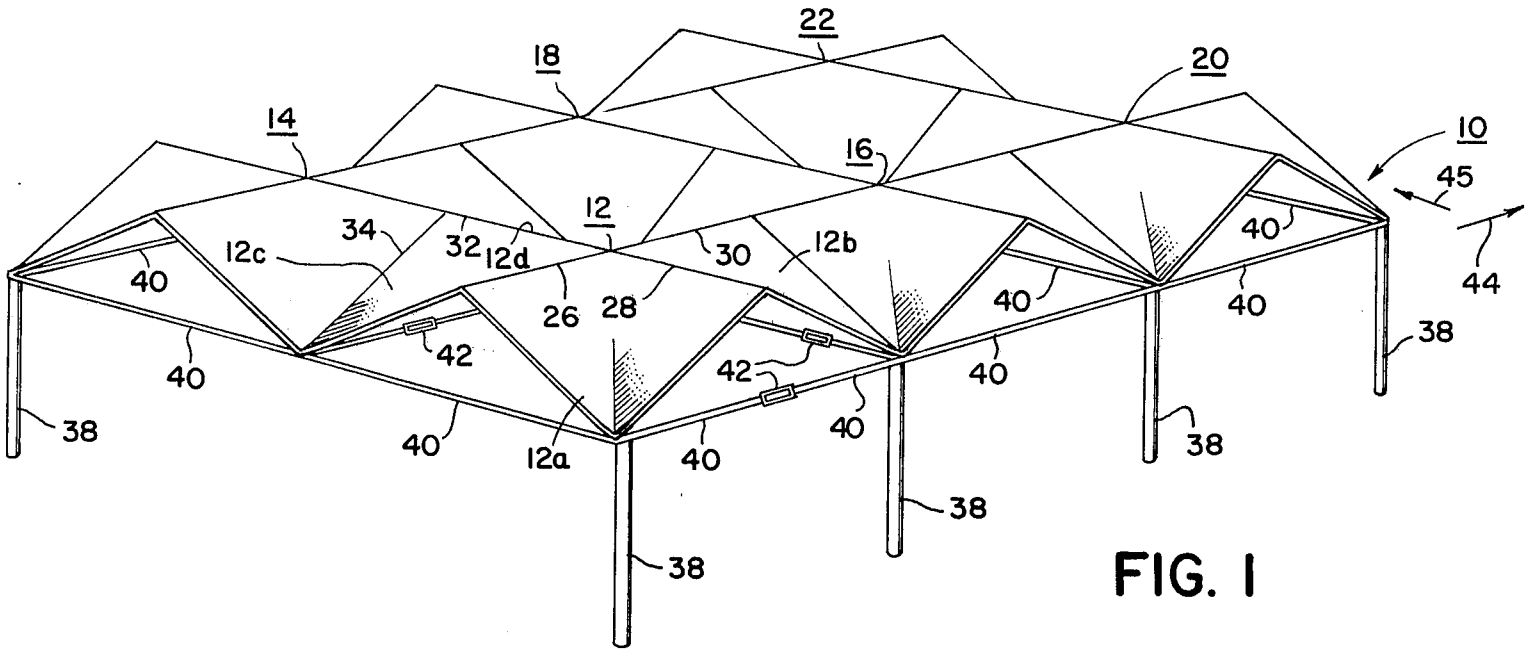
FIG. 1 is an isometric view of a roof construction in accordance with this invention.

Although specific terms are used in the following description for the sake of clarity, these terms are intended to refer only to the particular structure of my invention selected for illustration in the drawings, and are not intended to define or limit the scope of the invention.

Referring to FIG. 1, the roof construction 10 is formed of multiple hyperbolic paraboloid units joined together to provide the desired roof span. In the embodiment shown for illustration, six such units 12, 14, 16, 18, 20 and 22 are employed. Preferably these units are identical, and are of the type described in my issued U.S. Pat. No. 3,653,166. For purposes of completeness, I will briefly describe the construction of the hyperbolic paraboloid unit 12.

Figure 3:
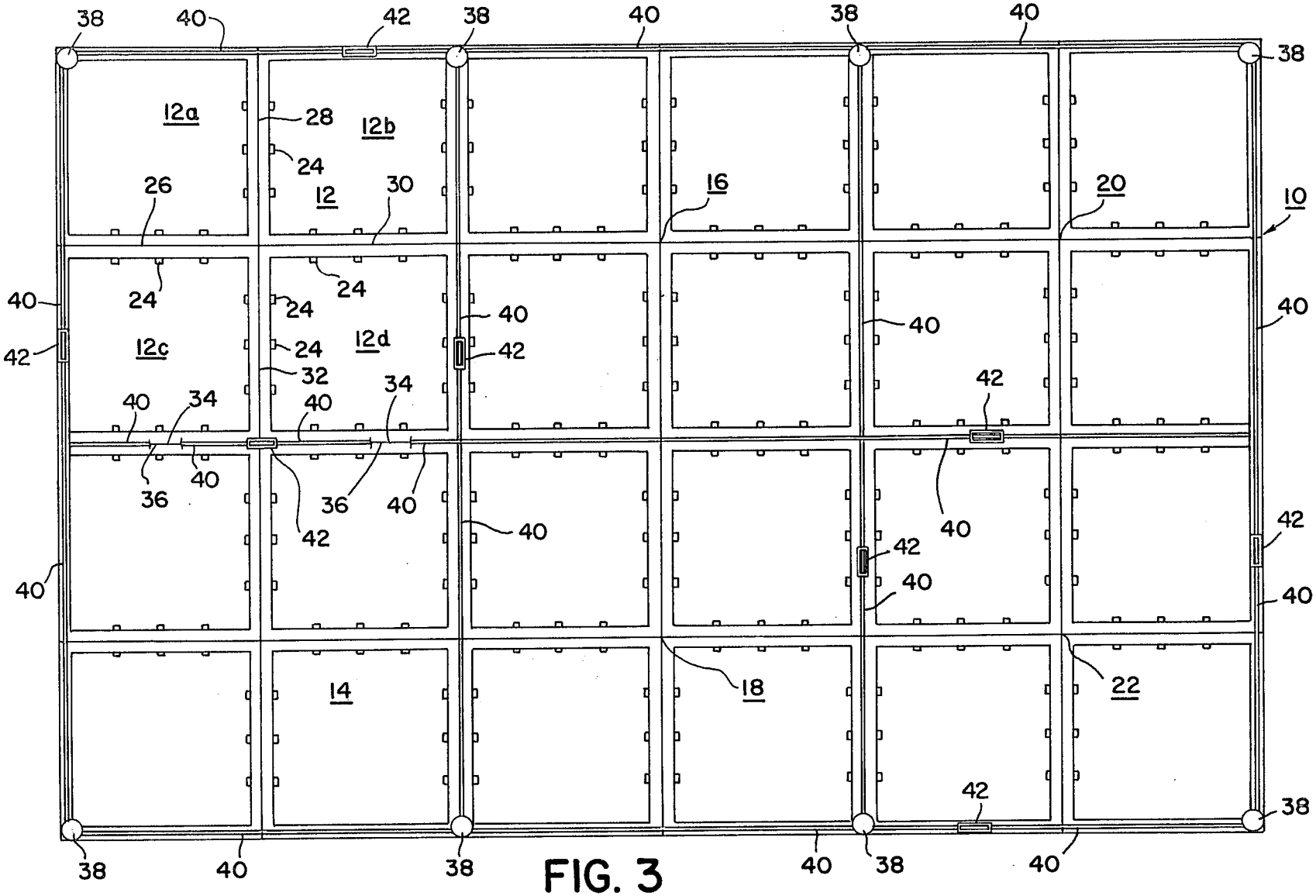
FIG. 3 is a bottom view of the roof construction shown in FIG. 1 with parts broken away to show details of construction.

Referring to FIGS. 1 and 3, the hyperbolic paraboloid unit 12 includes four quadrants 12*a*, 12*b*, 12*c* and 12*d*. Each of these quadrants is formed of two plywood layers that are laminated together, and the edges of each quadrant are stiffened, such as by edge beams formed from sized lumber. The edge beams are laminated to the surfaces of each quadrant, and the quadrants are connected together through the edge beams by bolts, screws or the like, as is schematically indicated at 24 in FIG. 3.

Each quadrant of the unit 12 has a pair of stiffened horizontal edges and a pair of stiffened sloping edges. The horizontal edges of each quadrant are joined to horizontal edges of adjacent quadrants so that these joined edges lie in a common horizontal plane. The joined horizontal edges of the unit 12 are shown at 26, 28, 30 and 32 (FIGS. 1 and 3) and they all lie in the top horizontal plane of the roof construction 10. Adjacent hyperbolic paraboloid units are joined together through contiguous sloping edges. For example, the adjacent hyperbolic paraboloid units 12 and 14 are joined together through their contiguous sloping edges as indicated at 34 and 36 (FIGS. 1 and 3). The adjacent hyperbolic paraboloid units are joined together so that all of the stiffened horizontal edges lie in the same horizontal plane. In the roof construction 10, the horizontal stiffened edges all lie in the top horizontal plane that includes the joined edges represented at 26, 28, 30 and 32.

Figure 2:
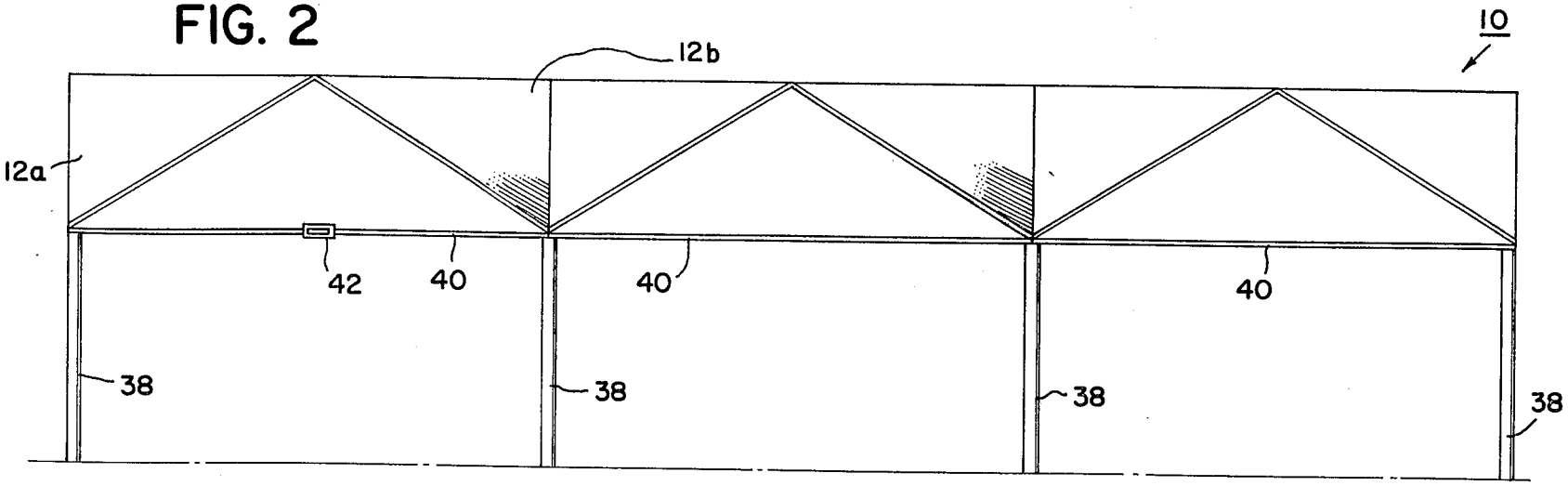
FIG. 2 is a side elevation view of the roof construction shown in FIG. 1.

Referring to FIGS. 1–3, vertical support members 38 are positioned about the periphery of the roof construction for supporting the horizontal span formed from the hyperbolic paraboloid units. These vertical supports 38 are connected to the ends of sloping edges of the hyperbolic paraboloid units, but not in the interior of the roof construction 10 (FIG. 3). In other words, the roof construction 10 is a free span construction in which vertical columns or supports are positioned only about the periphery.

The free span of roof construction 10 is made possible by employing horizontally positioned members 40, such as multistrand cables, that are tensioned between and connected to adjacent free ends of the sloping edges of the hyperbolic paraboloid units 12, 14, 16, 18, 20 and 22. These horizontally tensioned members cooperate with the shell field and the stiffened horizontal edges of the hyperbolic paraboloid units to establish a statically determinate truss. If desired, either some or all of the horizontally tensioned members can be provided with adjustment means, such as turnbuckles 42, to permit adjustment of the tension.

The roof construction 10 of this invention is a statically determinate truss provided by top and bottom chords connected together through diagonal web members. The top chord is provided by the stiffened horizontal edges that lie in the top horizontal plane of the roof construction 10, as described earlier. The bottom chord is provided by the horizontally positioned tensioned members 40, and the connecting webs are provided by the sloping edges and the shell fields of the hyperbolic paraboloid units. Since the stiffened edges are actually part of the hyperbolic paraboloid quadrants or shells, these shells actually are used to form one of the chords as well as the connecting web members.

In accordance with this invention, the roof span can be varied, as desired, by adding hyperbolic paraboloid units in the two horizontal directions indicated by arrows 44 and 45 (FIG. 1). In this manner large areas can be spanned without the necessity of utilizing interior vertical columns, and without the necessity of employing excessively large hyperbolic paraboloid units that require complex field assembly operations.

In order to structurally design the truss arrangement, the shell stresses for the individual hyperbolic paraboloid units are added to any stresses that are developed by the truss action, and the structural elements are proportioned to carry the maximum total stresses imposed upon the system. In view of the fact that the roof construction is formed from hyperbolic paraboloid units, the stresses carried by the members due to shell and truss action are axial tension or compression, without any bending. Thus, all of the members are employed in the roof construction can be designed primarily as axially loaded elements, which provides for simplicity of design.

Figure 4:
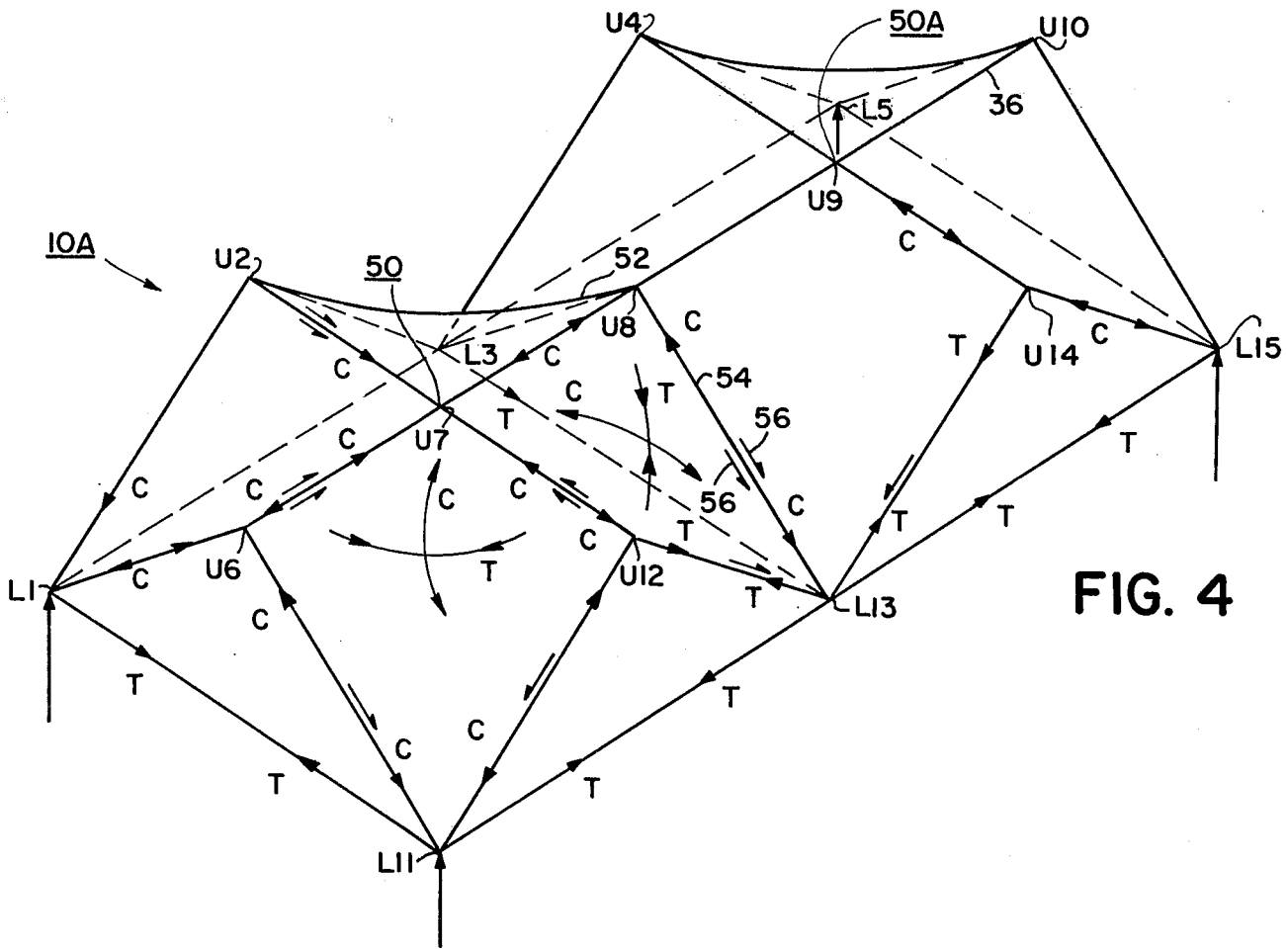
FIG. 4 is an isometric view of a roof construction employing two hyperbolic paraboloid units and showing the shell field force distribution when the roof is subject to vertical loading.
Figure 5:
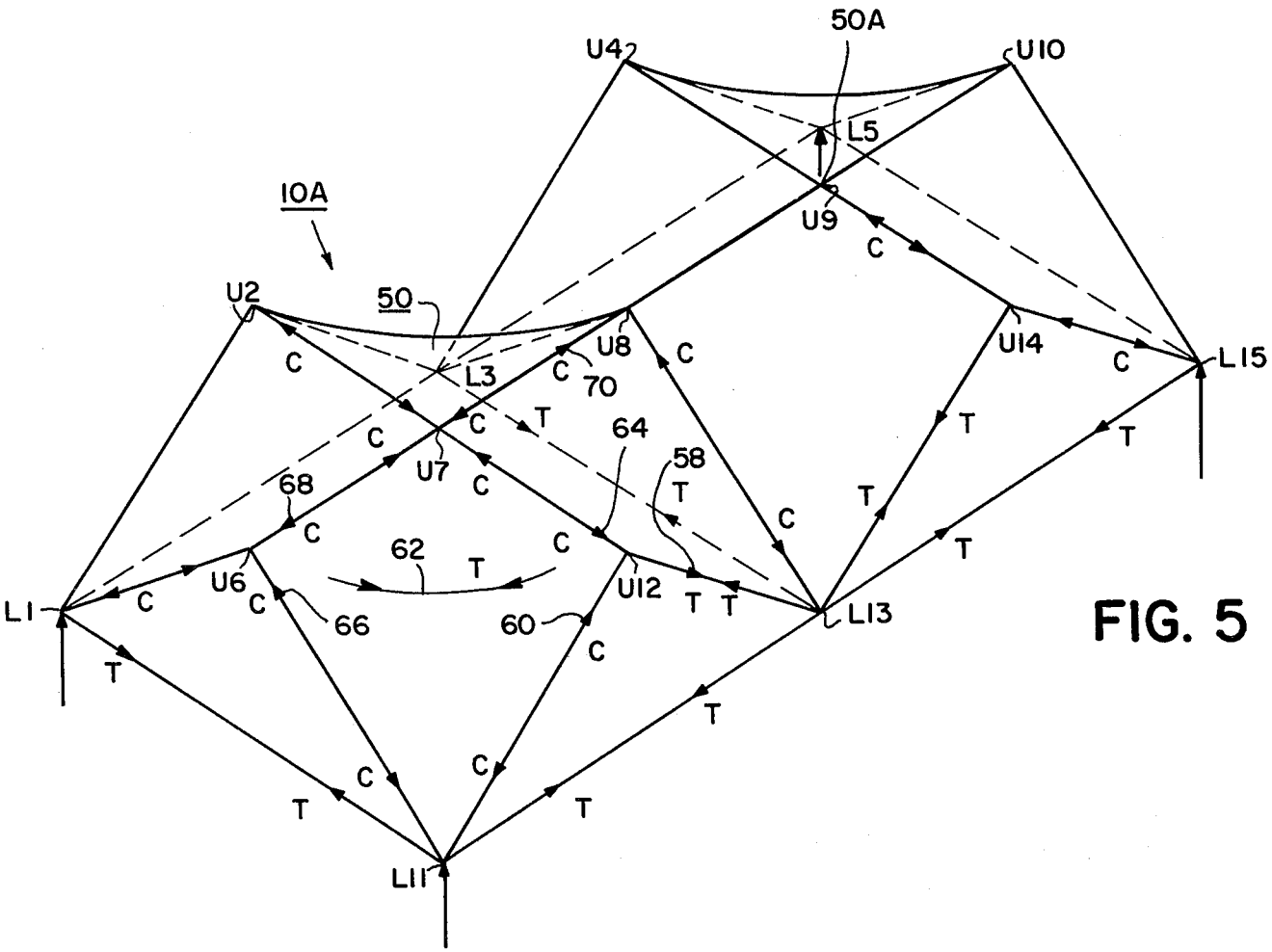
FIG. 5 is an isometric view of the construction of FIG. 4 showing the load distribution that provides for a statically determinate truss arrangement.

Referring to FIGS. 4 and 5, an explanation of the loading encountered in a roof construction 10A of this invention that employs two hyperbolic paraboloid units 50 and 50A will now be described. It should be understood that a similar analysis can be employed in roof constructions including more than two hyperbolic paraboloid units; such as, for example, the six unit roof construction 10 shown in FIGS. 1–3. In fact, the analysis of the construction 10A shown in FIG. 4 can actually be viewed as an analysis of the loading encountered in the two hyperbolic paraboloid units 12 and 14 of the roof construction 10. Note that the hyperbolic paraboloid units 12 and 14 provide a two unit span that is supported by four vertical members 38 at the periphery thereof (FIG. 3). These four members each provide a vertical reaction force of the type indicated at L1, L5, L15 and L11 of the roof construction 10A (FIG. 4). Also, it should be noted that vertical supports are not provided at the ends of the joined sloping edges 34 and 36 of the units 12 and 14 in the roof construction 10 (FIG. 3). This corresponds to the omission of vertical reaction forces at L3 and L13 in the roof construction 10A. Accordingly, the roof construction 10 shown in FIGS. 1–3 can be considered as a combination of three of the units 10A shown in FIGS. 4 and 5. Therefore the loading analysis of the unit 10A is, with only slight modification, equally applicable to the analysis of the six unit roof construction 10.

Referring specifically to FIG. 4, the roof construction 10A includes the two hyperbolic paraboloid units 50 and 50A that are joined together through sloping edges indicated at 52, 54 respectively. The units 50 and 50A are identical and are the same as the hyperbolic paraboloid units employed in the roof construction 10. As can be seen in FIG. 4, the horizontal stiffened edges that are joined together all lie in a common top horizontal plane. As explained earlier, external vertical reaction forces, such as those provided by vertical support columns 38 are established at the ends of the sloping edges, indicated at L1, L5, L11 and L15. Also as explained earlier, there is no external vertical reaction forces provided at the ends L3 and L13 of the joined sloping edges of the units 50 and 50A. Horizontally tensioned members, such as cable, are in force transmitting relationship between the adjacent ends of the sloping edges. Specifically, tensioned cable members are connected between L1-L3, L3-L5, L5-L15, L15-L13, L13-L3, L13-L11 and L11-L1. These tensioned cable members provide the bottom chord in the statically determinate truss arrangement. As explained earlier, the top chord is provided by the stiffened horizontal edges that are disposed in the top horizontal plane, and the two chords are connected together through the sloping edges and the shell fields of the hyperbolic paraboloid units.

The shell action stresses are indicated by the various arrows shown in FIG. 4. The arrows designated "T" indicate regions in axial tension; the arrows designated "C" indicate regions in axial compression; and the arrows of the type designated 56 indicate the shear force that is transmitted from the shell field of each quadrant to the stiffened edges. The conditions shown in FIG. 4 are encountered under uniform vertical loading of the roof construction. Under this vertical loading, the various shell fields are under axial compression "C" in the set of upwardly concave parabolas (e.g., along diagonal L11-U7) and are in axial tension "T" in the set of downwardly concave parabolas (e.g., along diagonal U6-U12). The load imposed upon each shell field is transmitted to the sloping edges of the quadrants, such as the sloping edges U8-L13 and U12-L13. When the ends of the various sloping edges are provided with an exterior vertical reaction, such as that which can be provided by a vertical column, the sloping edges are generally axially loaded in compression. For example, the sloping edges U6-L11 and U12-L11 are loaded in compression since an external vertical reaction force is provided at their junction.

By eliminating the use of interior vertical columns in a roof construction of the type shown in FIGS. 1–3, there will be a number of sloping edges that will not be provided with an external vertical reaction force at their ends. In FIG. 4, this is represented by the omission of external vertical reactions at L3 and L13. Because there are no external vertical reactions at L3 and L13, the sloping edges U2-L3, U4-L3, U12-L13 and U14-L13 are all stressed in tension, rather than in compression. The sloping surfaces U8-L13 and U8-L3 (the joined edges of the hyperbolic paraboloid units 50 and 50A) are stressed in compression since the force in these joined edges can be balanced by the other sloping edges that meet at L3 and L13. In order to provide a statically determinate truss it is important to balance the tensile stresses that are set up in the various sloping edges. For example, the tensile stress built up in the sloping edges U12-L13 must be balanced at U12.

Referring to FIG. 5, the manner in which the various loads and forces are balanced by the truss arrangement will now be described in connection with unit 50. The tensile stress in U12-L13 can be regarded as an additional load at U12, and that load is designated by arrow 58. The sloping edge U12-L11 must then be additionally loaded in compression, as indicated by arrow 60, and the shell field from U6 to U12 must pick up an additional tensile stress from the truss action, in addition to the shell action tensile stress depicted in FIG. 4. The combined tensile stress from the shell and truss action is schematically represented by the curved arrow 62. In addition, the horizontal stiffened connection between U7-U12 takes added compression as indicated by arrow 64 to balance the load at U12. At U6 the added tensile stress in the shell field indicated by arrow 62 is balanced by an added compression of the stiffened sloping edge U6-L11, as indicated by arrow 66, and by an added compression in the stiffened horizontal edges U6-U7 and U7-U8, as indicated by the arrows 68, 70, respectively.

From the above analysis it can be seen that the various stiffened edges and the shell field take up the shell action axial stresses plus the additional axial stresses induced by the truss action when some external vertical reactions are eliminated from the roof construction. This permits the roof constructions of this invention to be formed with large spans without the use of internal vertical support members.

It is within the scope of this invention to vary the configuration of the roof construction. For example, the roof construction 10 (FIGS. 1–3) can be inverted so that the horizontally stiffened edges of the hyperbolic paraboloid units form the bottom chord of the truss. In this variant the member 40 will constitute the top chord of the truss, and the top and bottom chords will still be connected by the shell field.

As used throughout this application, all references to hyperbolic paraboloid units refer to units having four quadrants, each of a hyperbolic paraboloid configuration. However, reference in the claims to the use of a plurality of multiple hyperbolic paraboloid units does not preclude the possibility that at least some of the units will contain less than four quadrants; provided that at least two of the units contain four quadrants.

Having described my invention, I claim:

1. A roof construction comprising at least a pair of juxtaposed hyperbolic paraboloid units, each unit comprising four quadrants, each quadrant having a pair of spaced, stiffened, horizontal edges and a pair of spaced, stiffened, sloping edges, the sloping edges sloping downwardly from an upper level to a lower level, two sloping edges of the first unit being contiguous to two sloping edges of the second unit and the other sloping edges of the units being non-contiguous, the stiffened horizontal edges all lying in a top, horizontal plane;

the juxtaposed units being joined together at respective contiguous sloping edges thereof to form a multiple unit roof span that includes both horizontally extending edges and sloping edges, a plurality of vertical members supporting the roof span at the lower ends of only the non-contiguous sloping edges; and first horizontally disposed and tensioned members connecting the lower ends of the sloping edges that are unsupported by vertical members with the lower ends of sloping edges that are supported by vertical members, the first tensioned members all lying in a lower horizontal plane, whereby a free span roof construction is provided.

2. The roof construction of claim 1 wherein the joined units are defined by an outer periphery and wherein the vertical members are positioned only at the periphery.

3. The roof construction of claim 1 wherein one of said pair of spaced horizontal edges in a quadrant is disposed at right angles to the other of said pair of spaced horizontal edges.

4. The roof construction of claim 1 wherein the lower horizontal plane is spaced below the top horizontal plane by a distance equal to the vertical distance between the upper level of a sloping edge and the lower level of a sloping edge.

5. The roof construction of claim 1 and second horizontally disposed and tensioned members connecting the lower edges of respective sloping edges that are supported by vertical members.

6. The roof construction of claim 5 wherein the first horizontally disposed and tensioned members are positioned at right angles to the second horizontally disposed and tensioned members.

* * * * *